US010183781B2

(12) United States Patent
Parque

(10) Patent No.: US 10,183,781 B2
(45) Date of Patent: Jan. 22, 2019

(54) FIREPROOF ENVELOPE ASSEMBLY

(71) Applicant: Gary Parque, Beckwourth, CA (US)

(72) Inventor: Gary Parque, Beckwourth, CA (US)

( * ) Notice: Subject to any disclaimer, the term of this patent is extended or adjusted under 35 U.S.C. 154(b) by 0 days.

(21) Appl. No.: 15/405,878

(22) Filed: Jan. 13, 2017

(65) Prior Publication Data

US 2018/0201412 A1 Jul. 19, 2018

(51) Int. Cl.
*B65D 27/00* (2006.01)
*B65D 27/20* (2006.01)

(52) U.S. Cl.
CPC ..... *B65D 27/20* (2013.01)

(58) Field of Classification Search
CPC ..... B65D 81/3897; B65D 81/3858; B65D 27/00; B65D 27/005
USPC ..... 229/77, 68.1, 103.11
See application file for complete search history.

(56) References Cited

U.S. PATENT DOCUMENTS 2,022,251 A * 11/1935 Mallay ..... B65D 29/00 109/29
2,189,055 A * 2/1940 Cage ..... B65D 5/563 206/105
2,322,345 A * 6/1943 Cage ..... B65D 5/563 206/105
2,690,199 A * 9/1954 Bennorth ..... B65D 33/00 109/82
3,066,847 A * 12/1962 Fortune ..... B65D 81/3897 109/82
3,292,748 A * 12/1966 Rifkin ..... A45C 3/00 190/119
3,428,104 A * 2/1969 Ary ..... B65D 27/00 150/149
3,637,000 A 1/1972 Walger et al.
3,769,146 A * 10/1973 Ravel ..... E04B 1/946 428/219
4,203,521 A * 5/1980 Dunn ..... B65D 75/00 206/525
4,395,453 A * 7/1983 Lines, Jr. ..... B32B 15/12 428/216
4,401,707 A * 8/1983 Bailey ..... A41D 31/0038 428/166
4,992,310 A 2/1991 Gelb et al.
5,056,603 A * 10/1991 Parkinson ..... A62C 3/00 169/26
5,913,607 A * 6/1999 Lengyel, Sr. ..... A45C 13/00 383/110
6,336,340 B1 * 1/2002 Laby ..... A61J 1/165 62/371
6,572,948 B1 * 6/2003 Dykhoff ..... A62C 2/065 169/56
6,881,506 B2 4/2005 Anderson et al.
7,018,699 B2 * 3/2006 Dykhoff ..... B32B 17/02 428/76
8,424,335 B2 * 4/2013 Corder ..... A61J 1/165 229/103
D685,843 S 7/2013 Glass et al.
9,469,440 B1 * 10/2016 Flood ..... B65D 33/00
2002/0056713 A1 5/2002 Rose
(Continued)

*Primary Examiner* — Brian D Nash

(57) ABSTRACT

A fireproof envelope assembly for protecting a flammable object from fire damage includes an envelope that contains a flammable object. The envelope is comprised of a fire resistant material to inhibit the flammable object from being damaged by fire.

1 Claim, 3 Drawing Sheets

(56) References Cited

U.S. PATENT DOCUMENTS

| | | | | |
|---|---|---|---|---|
| 2010/0027920 | A1* | 2/2010 | Raidl | A45C 3/001 383/42 |
| 2014/0050517 | A1 | 2/2014 | Williams et al. | |

* cited by examiner

FIREPROOF ENVELOPE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to envelope devices and more particularly pertains to a new envelope device for protecting a flammable object from fire damage.

BRIEF SUMMARY OF THE INVENTION

An embodiment of the disclosure meets the needs presented above by generally comprising an envelope that contains a flammable object. The envelope is comprised of a fire resistant material to inhibit the flammable object from being damaged by fire.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
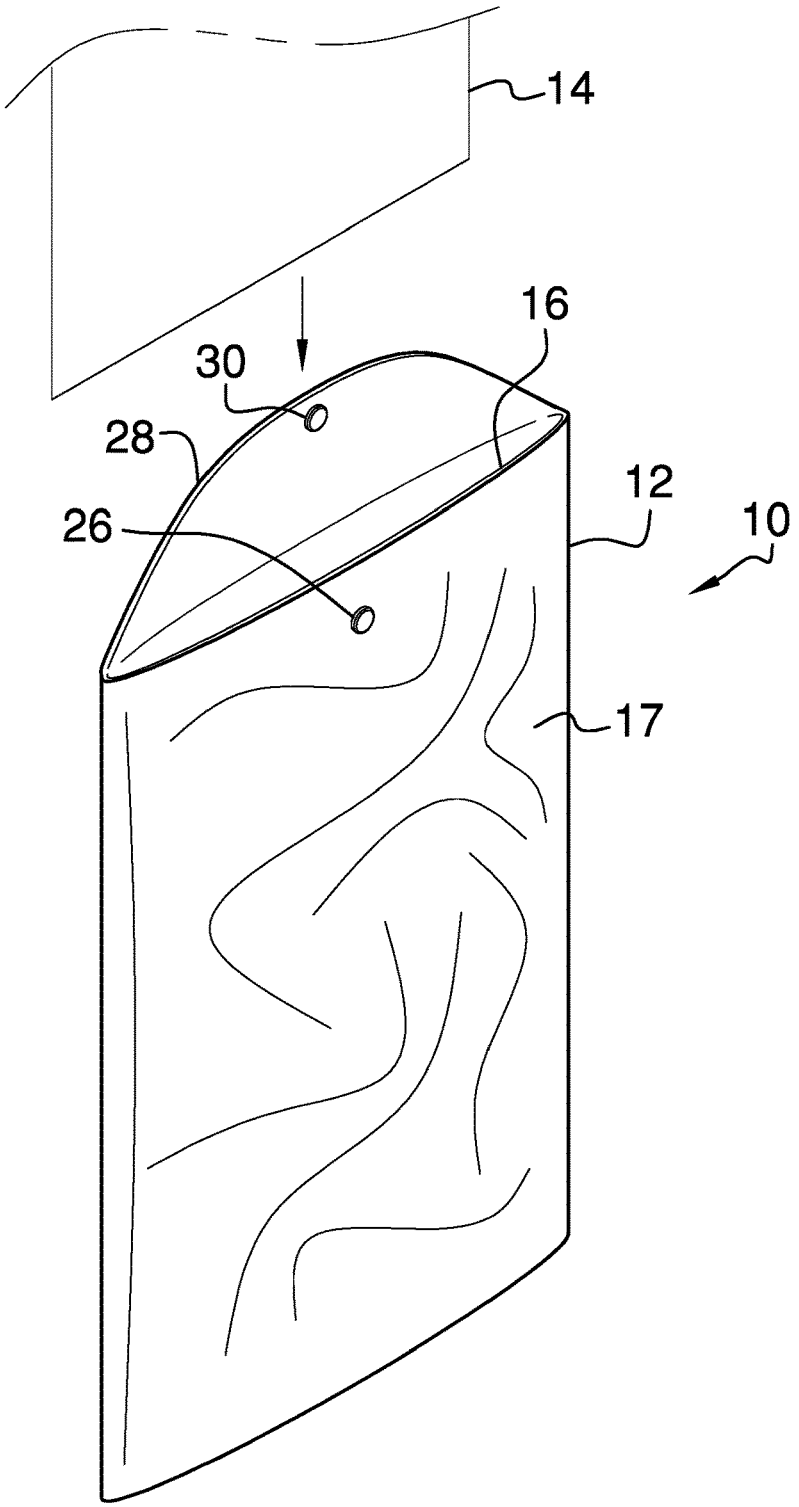
FIG. 1 is a front perspective view of a fireproof envelope assembly according to an embodiment of the disclosure.
Figure 2:
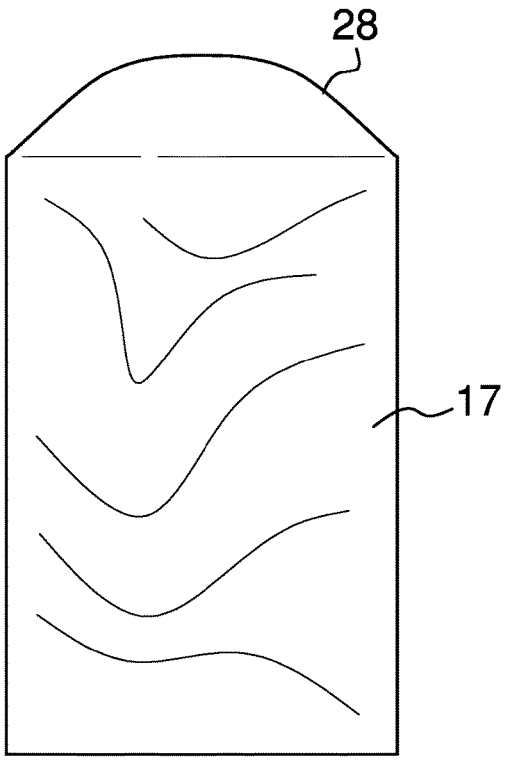
FIG. 2 is a back view of an embodiment of the disclosure.
Figure 3:
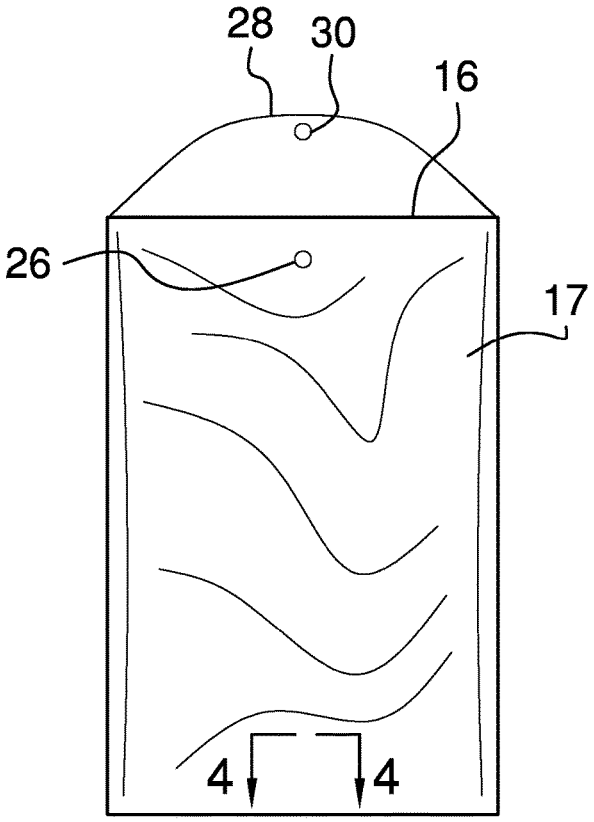
FIG. 3 is a front view of an embodiment of the disclosure.
Figure 4:
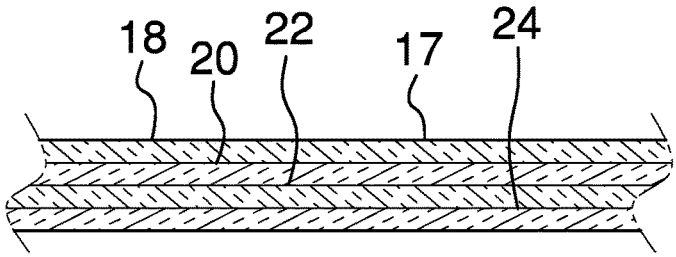
FIG. 4 is a cross sectional view taken along line 4-4 of FIG. 3 of an embodiment of the disclosure.
Figure 5:
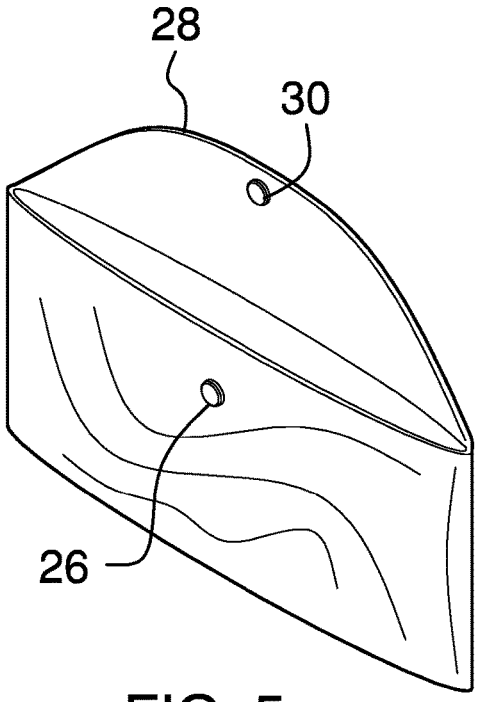
FIG. 5 is a top front side perspective view of an embodiment of the disclosure.

With reference now to the drawings, and in particular to FIGS. 1 through 5 thereof, a new envelope device embodying the principles and concepts of an embodiment of the disclosure and generally designated by the reference numeral 10 will be described.

As best illustrated in FIGS. 1 through 5, the fireproof envelope assembly 10 generally comprises an envelope 12 that may contain a flammable object 14. The envelope 12 is comprised of a fire resistant material to inhibit the flammable object 14 from being damaged by fire. The flammable object 14 may be a document, a painting or any other irreplaceable, flammable object. The fire resistant material may comprise a pyrophobic polymer, spun silica or other pyrophobic material. The envelope 12 may have dimensions corresponding to a manila envelope, a letter envelope or any other type of envelope.

The envelope 12 has a top side 16 and an outer wall 17. The top side 16 is open to access an interior of the envelope 12. The outer wall 17 has a first layer 18, a second layer 20, a third layer 22 and a fourth layer 24. Moreover, each of the first 18, second 20, third 22 and fourth 24 layers are comprised of the fire resistant material. Each of the first 18, second 20, third 22 and fourth 24 layers are bonded together through a chemical bond, a fire resistance adhesive or other means of fire resistant attachment. The first 18, second 20, third 22 and fourth 24 layers each resists heat transmission thereby enhancing protecting the flammable object 14 within the envelope 12.

A first mating member 26 is provided and the first mating member 26 is coupled to the outer wall 17 of the envelope 12. The first mating member 26 is positioned adjacent to the top side 16 and the first mating member 26 may be a button snap or other fire resistant closure.

A flap 28 is coupled to the top side 16 to close the envelope 12. The flap 28 is comprised of the fire resistant material of which the envelope 12 is comprised. A second mating member 30 is provided and the second mating member 30 is coupled to the flap 28. The second mating member 30 engages the first mating member 26 to retain the flap 28 to close the top side 16. The second mating member 30 may be a button snap or other fire resistant closure.

In use, the flammable object 14 is positioned in the envelope 12 and the flap 28 is closed. The first mating member 26 is manipulated to engage the second mating member 30 to keep the flap 28 closed. The envelope 12 is placed in a safe, a lockbox or other means of storage. The envelope 12 inhibits the flammable object 14 from being damaged by a structural fire or any other source of fire. In this way the envelope 12 ensures the flammable object 14 survives a fire.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fireproof envelope assembly being configured to prevent articles contained within said assembly from catching fire, said assembly comprising:

an envelope being configured to contain a flammable object, said envelope being comprised of a fire resistant material wherein said envelope is configured to inhibit the flammable object from being damaged by fire, said envelope having a top side, said top side being open to access an interior of said envelope, said envelope having a first layer, a second layer, a third layer and a fourth layer, each of said first, second, third and fourth layers being comprised of the fire resistant material, said first layer, said second layer, said third layer, and said fourth layer being bonded together by a fire resistant attachment consisting of a fire resistant adhesive or chemical bond;

a first mating member being coupled to said envelope, said first mating member being positioned adjacent to said top side;

a flap being coupled to said top side wherein said flap selectively closes said envelope, said flap being comprised of a fire resistant material; and a second mating member being coupled to said flap, said second mating member engaging said first mating member to retain said flap to close said top side.

* * * * *